US010232923B1

(12) United States Patent
Novak et al.

(10) Patent No.: US 10,232,923 B1
(45) Date of Patent: Mar. 19, 2019

(54) MARINES DRIVES AND PROPELLER SHAFT BEARING HUBS FOR MARINE DRIVES HAVING TURNING VANES THAT FACILITATE DISCHARGE OF EXHAUST GAS

(71) Applicant: Brunswick Corporation, Lake Forest, IL (US)

(72) Inventors: Randy K. Novak, Oshkosh, WI (US); Thomas F. Nickols, Oakfield, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 15/685,411

(22) Filed: Aug. 24, 2017

(51) Int. Cl.

| | |
|---|---|
| ***B63H 20/26*** | (2006.01) |
| ***B63H 23/32*** | (2006.01) |
| ***B63H 1/20*** | (2006.01) |
| *B63H 23/02* | (2006.01) |

(52) U.S. Cl.
CPC ..... *B63H 20/26* (2013.01); *B63H 1/20* (2013.01); *B63H 23/321* (2013.01); *B63H 23/02* (2013.01)

(58) Field of Classification Search
CPC ..... B63H 1/20; B63H 20/26; B63H 23/321
USPC ..... 416/245 A, 244 B
See application file for complete search history.

(56) References Cited

U.S. PATENT DOCUMENTS

| | | | | |
|---|---|---|---|---|
| 2,213,612 A * | 9/1940 | Ronning | B63H 20/26 416/93 R |
| 3,092,185 A * | 6/1963 | Alexander, Jr. | B63H 20/245 416/193 R |
| 4,212,586 A * | 7/1980 | Aguiar | B63H 1/20 416/93 A |
| 4,642,057 A | 2/1987 | Frazzell et al. | |
| 4,871,334 A | 10/1989 | McCormick | |
| 5,816,869 A | 10/1998 | Willows | |
| 6,068,529 A | 5/2000 | Weronke et al. | |

* cited by examiner

*Primary Examiner* — Stephen P Avila
(74) *Attorney, Agent, or Firm* — Andrus Intellectual Property Law, LLP

(57) ABSTRACT

A marine drive for propelling a marine vessel includes a lower gearcase, a propeller shaft laterally extending through the lower gearcase and configured to support a propeller, a propeller shaft bearing hub supporting the propeller shaft in the lower gearcase, and an exhaust passage that conveys exhaust gas through the lower gearcase to an underwater discharge outlet. The exhaust passage includes a first leg that conveys the exhaust gas downwardly in the lower gearcase and a second leg that redirects the exhaust gas laterally from the first leg to the underwater discharge outlet. The propeller shaft bearing hub comprises curved vanes that laterally redirects the exhaust gas from the first leg towards the underwater discharge outlet.

15 Claims, 5 Drawing Sheets

MARINES DRIVES AND PROPELLER SHAFT BEARING HUBS FOR MARINE DRIVES HAVING TURNING VANES THAT FACILITATE DISCHARGE OF EXHAUST GAS

FIELD

The present disclosure relates to marine drives and propeller shaft bearing hubs for marine drives, particularly to propeller shaft bearing hubs configured to facilitate discharge of exhaust gas via an underwater outlet.

BACKGROUND

U.S. Pat. No. 6,068,529 discloses an improved twin propeller marine propulsion unit. A vertical drive shaft is journaled in the lower gearcase and drives a pair of bevel gears. A pair of concentric propeller shafts is mounted in the lower torpedo section of the gearcase and each shaft carries a propeller. A slidable clutch is movable between a neutral, a forward, and a reverse position and serves to operably connect the outer propeller shaft with one of the bevel gears when the clutch is moved to the forward drive position. A gear is mounted for sliding movement in unison with the clutch and acts to operably engage the inner propeller shaft with the second bevel gear when the clutch is in the forward drive position so that both propellers are driven in opposite directions to provide forward motion for the watercraft. The propulsion unit also includes a dual cooling water pick-up system in which seawater is drawn to the water pump both through a series of vertical inlet ports in the gearcase and through a plurality of inlet holes that are located in the forward end of the lower torpedo section. Exhaust gas from the engine is discharged through the rear end of the lower housing section through axial passages in the hub of the forward propeller and then across the outer surface of the rear propeller.

U.S. Pat. No. 5,816,869 discloses a propeller for a marine propulsion system that provides variable length exhaust paths depending upon the speed of the boat and motor. The propeller includes a propeller hub and an exhaust tube positioned within the propeller hub. The exhaust tube extends past the aft end of the propeller hub and defines a first exhaust passageway. A second exhaust passageway is positioned between the propeller hub and the exhaust tube. The second exhaust passageway is shorter than the first exhaust passageway. At low speeds, engine exhaust exits the longer first passageway, while at moderate speeds, engine exhaust exits the shorter second passageway. Therefore, the effective length of the exhaust path varies depending upon the speed of the motor, such that the length of the exhaust path is specifically tuned to several speeds of the motor U.S. Pat. No. 4,871,334 discloses a marine propulsion device includes a drive housing to which is attached a suitable engine, the exhaust of which is pumped downwardly through a suitable passage in the drive housing to adjacent a torpedo housing carrying at least one propeller. A generally horizontal anti-ventilation plate is disposed above the torpedo housing, and a strut extends between the plate and the torpedo housing, just forwardly of the upper portion of the propeller. Substantially all of the engine exhaust is forced by the engine from the drive housing passage for discharge into the path of the upper portion of the propeller. In one embodiment, substantially all of the exhaust passes through the strut and is discharged rearwardly therefrom into ventilating engagement with the forward face of the propeller. In another embodiment, a portion of the exhaust is also discharged downwardly through the anti-ventilation plate onto the upper edge portion of the propeller.

U.S. Pat. No. 4,642,057 discloses a marine propeller mounting arrangement that includes a sleeve member for mounting on a propeller shaft, a propeller having an inner hub which fits over the sleeve member and a cushion member fitting between the sleeve member and the propeller inner hub. The sleeve member includes radially extending projections registering with channels in the hub to positively drive the propeller, even in the event of failure of the cushion member. The propeller has an outer hub surrounding the inner hub to define an exhaust gas passageway through the propeller.

SUMMARY

This summary is provided to introduce a selection of concepts that are further described below in the detailed description. This summary is not intended to identify key or essential features of the claimed subject matter, nor is it intended to be used as an aide in limiting the scope of the claimed subject matter.

In certain examples disclosed herein, a marine drive for propelling a marine vessel has a lower gearcase, a propeller shaft that laterally extends through the lower gearcase and is configured to support a propeller, a propeller shaft bearing hub that supports the propeller shaft in the lower gearcase, and an exhaust passage that conveys exhaust gas through the lower gearcase to an underwater discharge outlet. The exhaust passage includes a first leg that conveys the exhaust gas downwardly in the lower gearcase and a second leg that redirects the exhaust gas laterally from the first leg to the underwater discharge outlet. The propeller shaft bearing hub has a plurality of curved vanes that laterally redirects the exhaust gas from the first leg towards the underwater discharge outlet.

BRIEF DESCRIPTION OF THE DRAWINGS

Embodiments are described herein below with reference to the following drawing figures. The same numbers are used throughout the figures to reference like features and components.

DETAILED DESCRIPTION OF THE DRAWINGS

Figure 1:
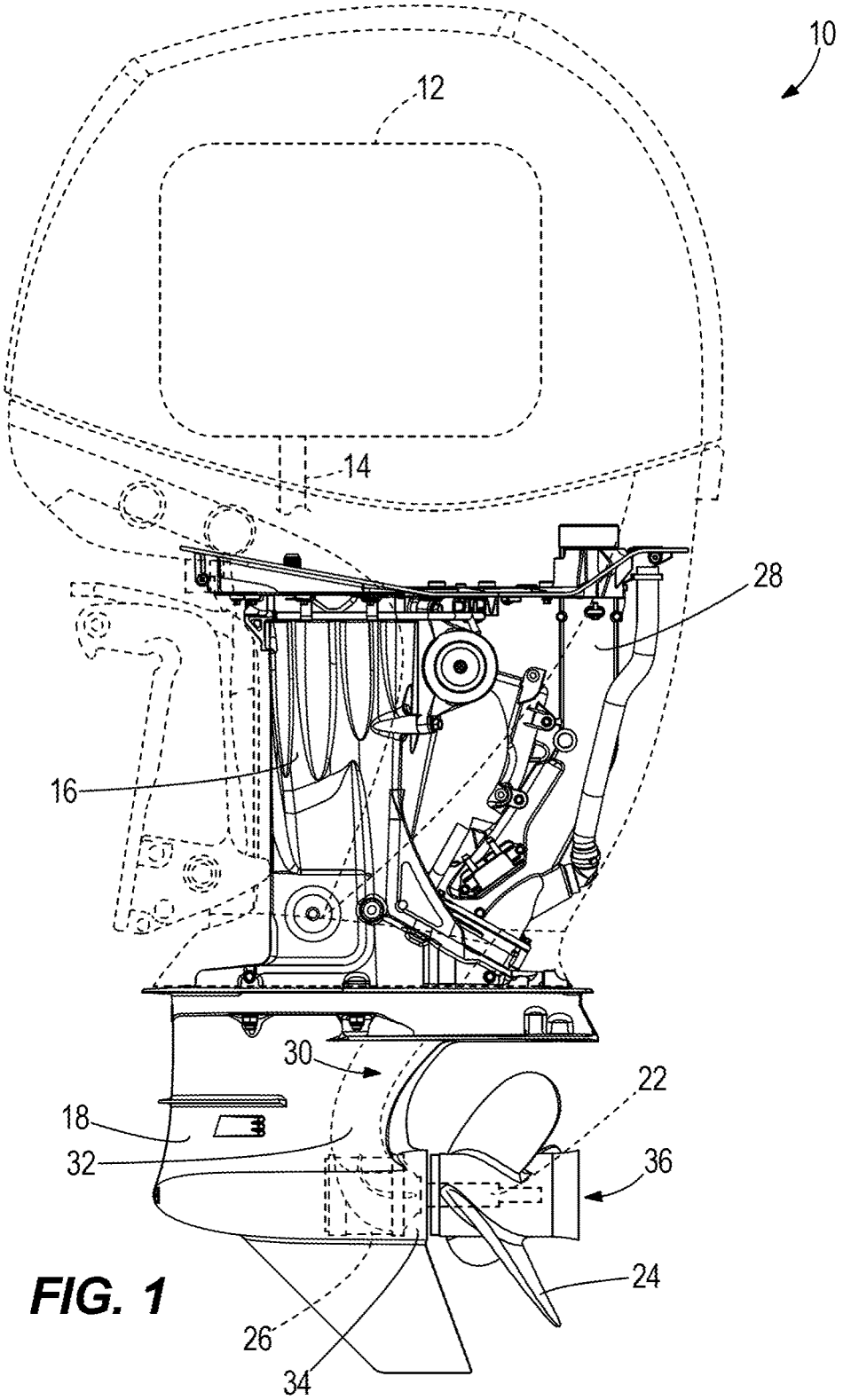
FIG. 1 is a side view of a marine drive according to the present disclosure.
Figure 2:
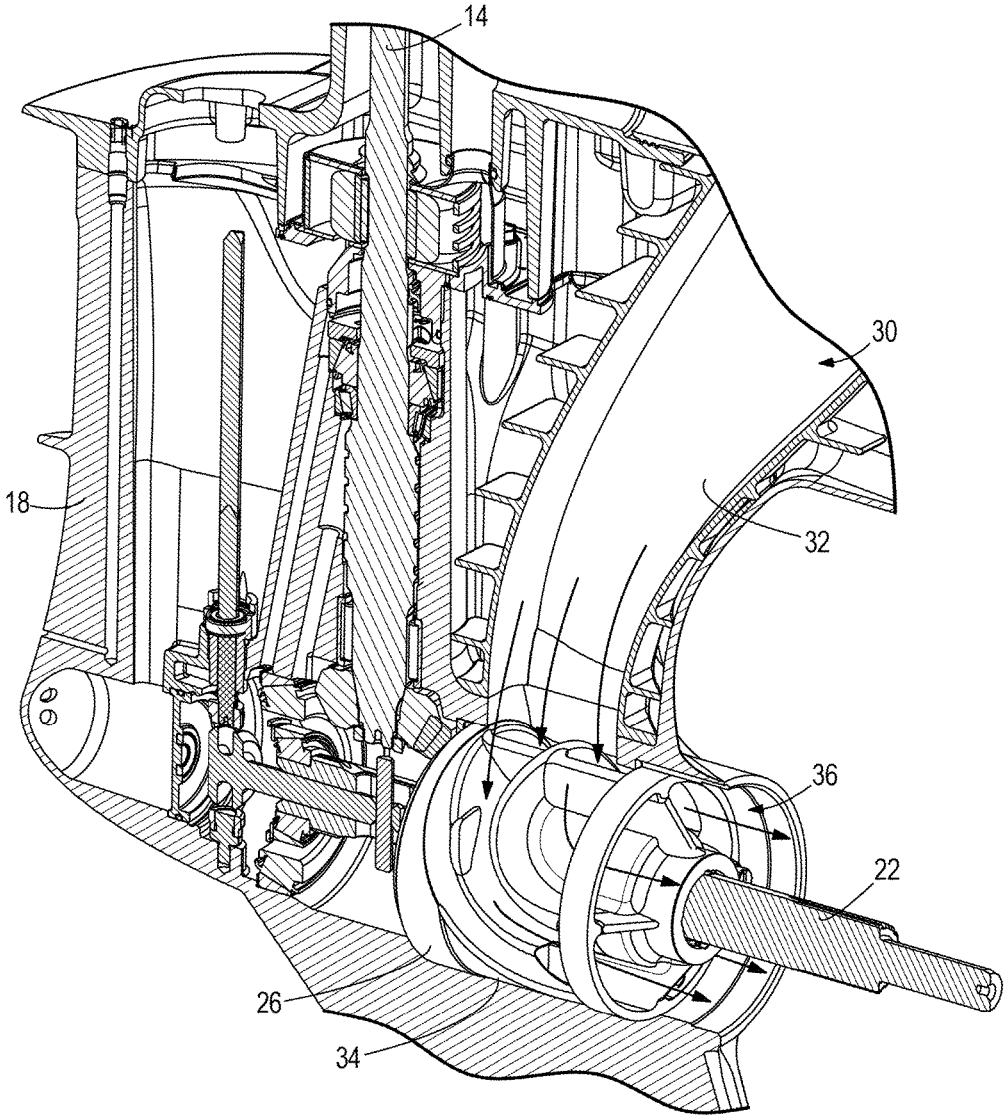
FIG. 2 is a section view, taken in perspective, showing portions of the lower gearcase shown in FIG. 1
Figure 3:
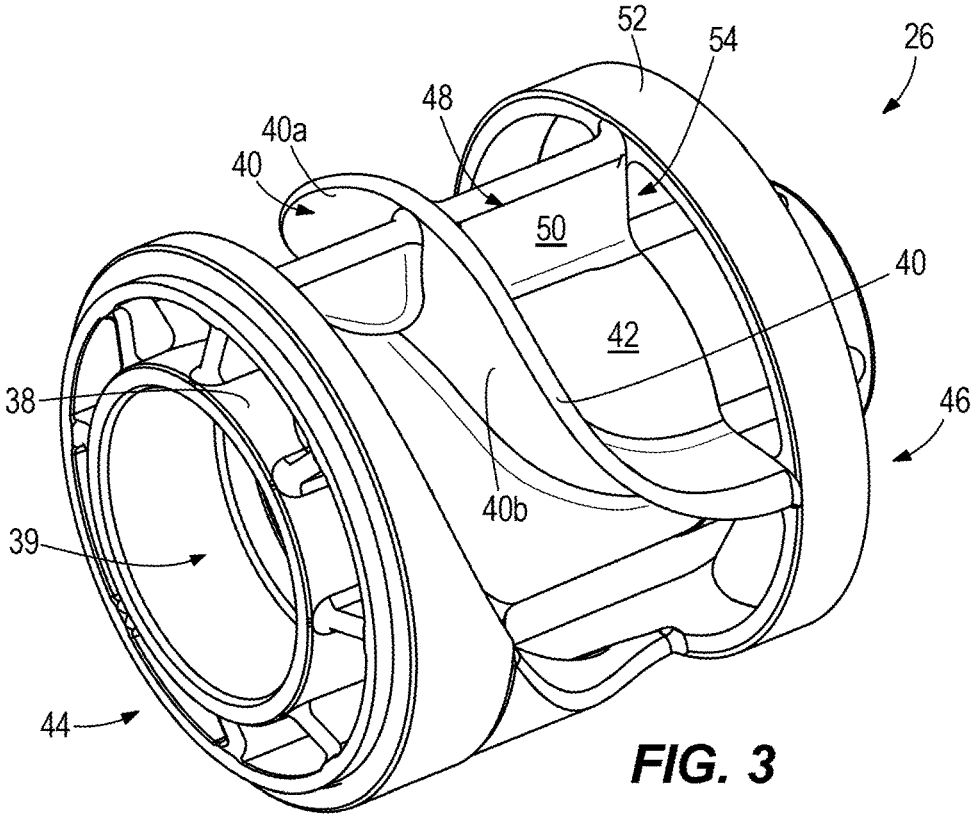
FIG. 3 is an isolated perspective view of one example of a propeller shaft bearing hub according to the present disclosure.
Figure 4:
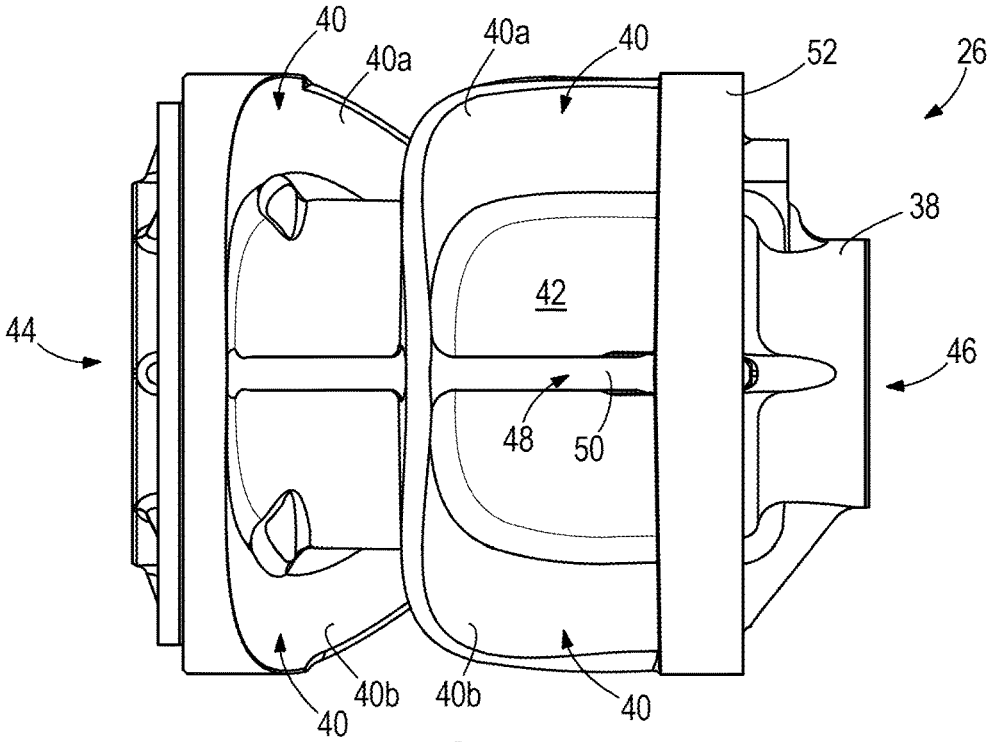
FIG. 4 is a top view of the propeller shaft bearing hub.
Figure 5:
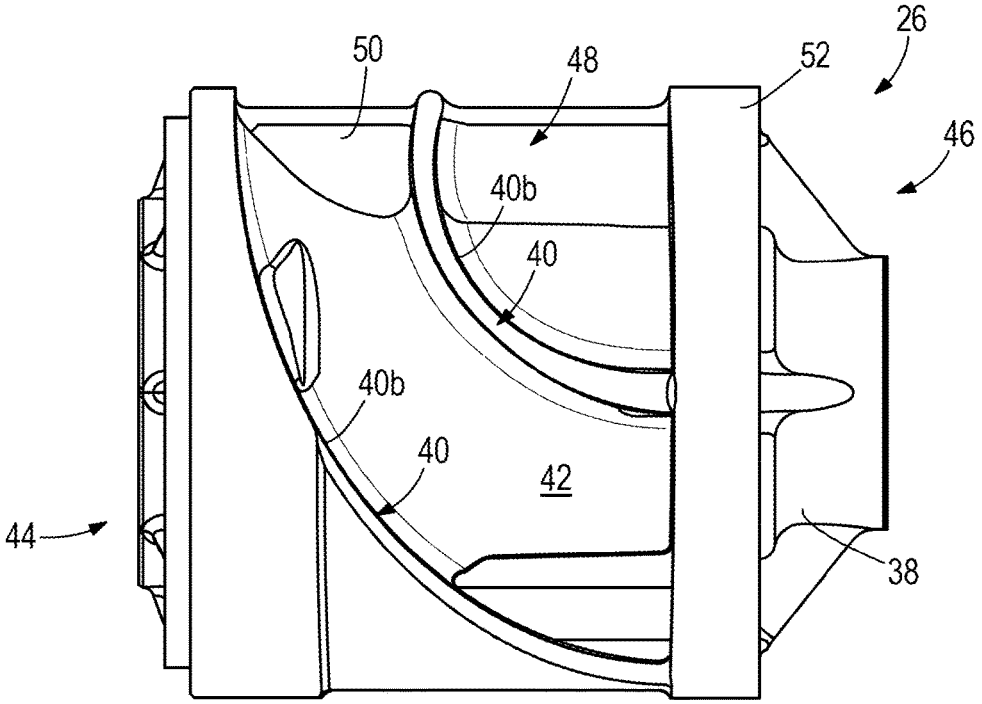
FIG. 5 is a side view of the propeller shaft bearing hub.

FIG. 1 depicts a marine drive, which in the illustrated example is an outboard motor 10. The exemplary outboard motor 10 includes an internal combustion engine 12 that causes rotation of a vertically extending driveshaft 14. As is conventional, the driveshaft 14 extends downwardly from the internal combustion engine 12 through a driveshaft housing 16 to a lower gearcase, which in this example includes a torpedo housing 18. As shown in FIG. 2, the lower end of the driveshaft 14 is engaged via a transmission gear assembly 20 to a propeller shaft 22 that laterally extends from the torpedo housing 18. The propeller shaft 22 supports a propeller 24 (FIG. 1) that is configured impart propulsive forces on the body of water in which the outboard motor 10 is operating. As is conventional, operation of the internal combustion engine 12 causes rotation of the driveshaft 14, which causes rotation of the propeller shaft 22 and propeller 24.

Although FIGS. 1 and 2 depict an outboard motor, the concepts of the present disclosure are also applicable to other types of marine drives, such as alternately configured outboard motors, inboard motors, stern drives, and/or the like.

As shown in FIGS. 1 and 2, a propeller shaft bearing hub 26 supports rotation of the propeller shaft 22 in the torpedo housing 18. As will be further described herein below, the propeller shaft bearing hub 26 is uniquely configured according to the principles of the present disclosure.

Referring again to FIGS. 1 and 2, the outboard motor 10 also includes an exhaust tube 28 that conveys exhaust gas downwardly from the internal combustion engine 12. The exhaust tube 28 extends downwardly through the driveshaft housing 16 to an exhaust passage 30 that extends into the torpedo housing 18. The exhaust passage 30 has a first leg 32 that conveys the exhaust gas generally downwardly into the torpedo housing 18 and a second leg 34 that redirects the exhaust gas generally laterally from the first leg 32 to an underwater discharge outlet 36, which in the illustrated example is formed through the propeller 24. The underwater discharge outlet 36 is configured to discharge the exhaust gas aftwardly into the body of water in which the outboard motor 10 is operating.

FIGS. 3-6 depict one example of the propeller shaft bearing hub 26 according to the present disclosure. The propeller shaft bearing hub 26 has a cylindrical body 38 with an axially-extending through-bore 39 through which the propeller shaft 22 extends. The propeller shaft bearing hub 26 also has a plurality of curved vanes 40 that radially extend from an outer surface 42 of the cylindrical body 38. The curved vanes 40 laterally redirect the exhaust gas from the first leg 32 towards the aftwardly-facing underwater discharge outlet 36.

The propeller shaft bearing hub 26 has an upstream end 44 and a downstream end 46. As shown by arrows in FIG. 2, the exhaust gas is conveyed downwardly via the first leg 32 onto the outer surface 42 of the propeller shaft bearing hub 26, between the upstream end 44 and the downstream end 46, and then is aftwardly redirected by the curved vanes 40 along the second leg 34, laterally towards the downstream end 46. A flow splitter 48 is located on top of the outer surface 42 of the propeller shaft bearing hub 26. The flow splitter 48 is configured to split the exhaust gas as it is conveyed downwardly onto the cylindrical body 38 of the propeller shaft bearing hub 26. The exact configuration of the flow splitter 48 can vary from what is shown. In the illustrated example, the flow splitter 48 includes a dorsal fin 50 that extends radially outwardly from the cylindrical body 38 and axially along the cylindrical body 38 from the upstream end 44 to the downstream end 46. In other examples, the dorsal fin 50 can axially extend only part-way along the cylindrical body 38 between the upstream and downstream ends 44, 46. The flow splitter 48 splits the exhaust gas so that a portion of the exhaust gas flows along one side of the propeller shaft bearing hub 26 and a portion of the exhaust gas flows along the opposite side of the propeller shaft bearing hub 26.

Figure 6:
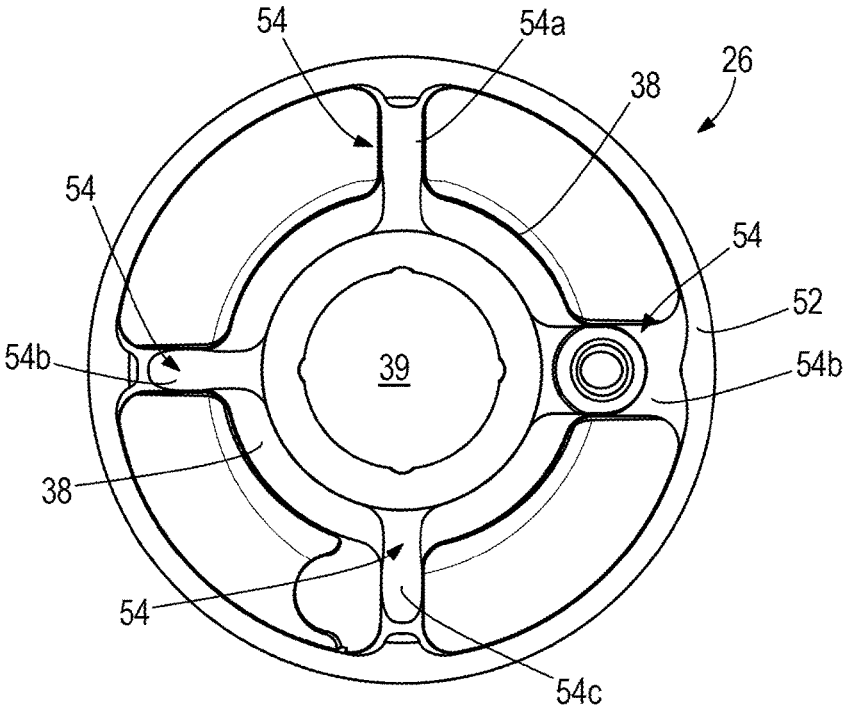
FIG. 6 is an end view of the propeller shaft bearing hub.

A supporting ring 52 is located at the downstream end 46 and is concentrically spaced apart from the cylindrical body 38 by a radially extending plurality of spokes 54 (best shown in FIG. 6). In this example, the curved vanes 40 and flow splitter 48 are coincident with the spokes 54 so that the exhaust gas freely passes through a plurality of windows defined between the ring 52, cylindrical body 38 and spokes 54, i.e., without being impeded by the spokes 54. In the illustrated example, the dorsal fin 50 extends forwardly up to and is coincident with an uppermost spoke 54*a* located along the top of the cylindrical body 38. The curved vanes 40 include opposing vane sections 40*a*, 40*b* that are aligned at and diametrically extend away from opposite sides of the dorsal fin 50. One curved vane 40 is located forwardly of the other along the cylindrical body 38. The aftwardly located first curved vane 40 has vane sections 40*a*, 40*b* that become coincident with diametrically opposing spokes 54*b* located along the sides of the cylindrical body 38. The forwardly located second curved vane 40 has vane sections 40*a*, 40*b* that merge together and become coincident with a lowermost spoke 54*c* located along the bottom of the cylindrical body 38.

Figure 7:
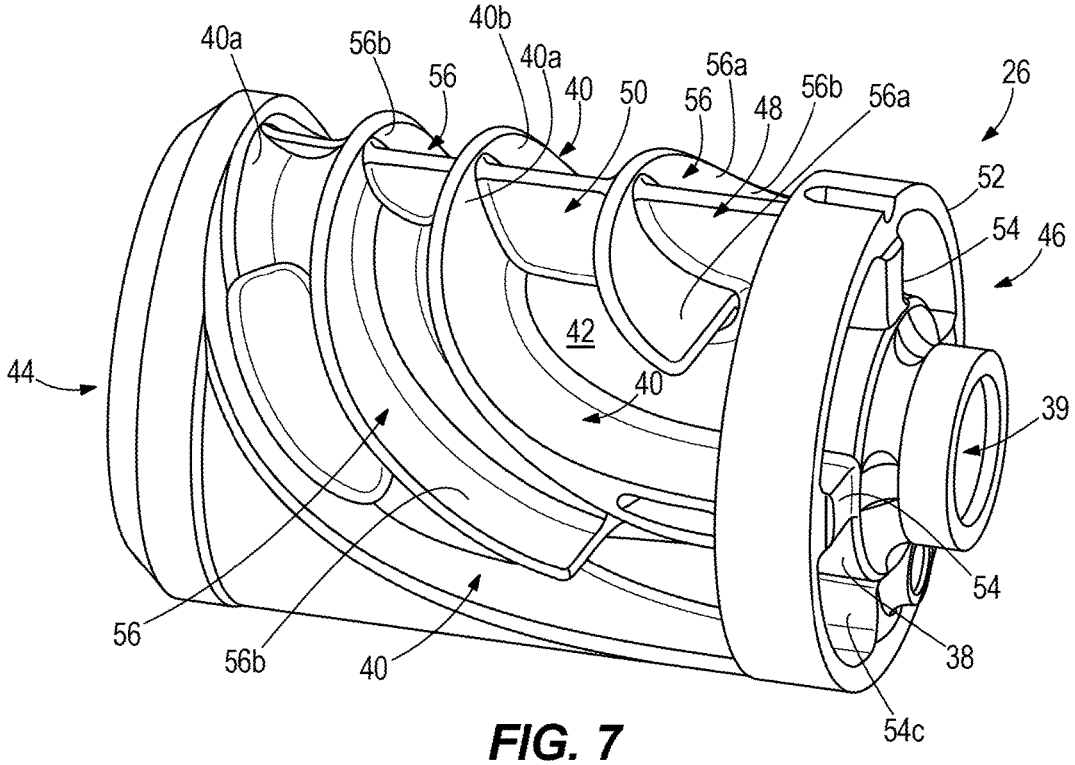
FIG. 7 is an isolated perspective view of another example of a propeller shaft bearing hub according to the present disclosure.

The number and configuration the curved vanes 40 can vary. In an alternate example shown in FIG. 7, a plurality of supplementary vanes 56 is interdigitated amongst the curved vanes 40. The supplementary vanes 56 are not coincident with the spokes 54. Optionally, the supplementary vanes 56 include a pair of first vane sections 56*a* and a pair of second vane sections 56*b* that is longer than the first vane sections 56*a* and located aftwardly of the first vane sections 56*a* along the cylindrical body 38. Optionally, the supplementary vanes 56 can extend axially short of, up to, or through the noted windows. In the illustrated example, both of the supplementary vanes 56 extend axially short of the windows (i.e. axially short of the ring 52).

Through research and experimentation, the present inventors have realized that conventional through-hub exhaust systems on marine drives often experience performance losses when the marine drive is first accelerated from a stationary position. In the stationary position, the lowermost extent of the marine drive's exhaust system is typically full of water. Upon initial acceleration, exhaust gas pressure from the internal combustion engine is required to force the water out of the exhaust system's underwater discharge outlet before the engine can achieve full power potential. This is inefficient. In addition, conventional exhaust systems in marine drives follow a tortuous path, which causes backpressure in the exhaust gas. The backpressure reduces power potential of the engine, essentially requiring the engine to force its own exhaust gas out of the system. This is otherwise referred to as pumping losses. This is also inefficient. Pumping losses can occur when the exhaust gas is redirected laterally from a vertical flow path, e.g. in the lower gearcase housing. Pumping losses can also occur when the exhaust gas impacts the propeller shaft bearing hub supporting the propeller shaft, and on support spokes on the propeller shaft bearing hub. Pumping losses can also occur as the exhaust gas expands into the gearcase cavity.

The present disclosure is the result of the inventors' efforts to remedy these drawbacks in the prior art. According to the present disclosure, exhaust gas that enters the lower gearcase is divided by the splitter and redirected by the curved vanes, which unloads the flow concentration from vertical to horizontal flow. Losses associated with impingement of exhaust gas flow on the support spokes is mitigated by joining the splitter and vanes to the spokes. Thus the exhaust gas is not abruptly parted and forced into the windows between the spokes. The guiding duct in the lower gearcase further mitigates expansion losses. The cavity in the gearcase can be sized substantially larger than necessary, which allows the expulsion of water from pre-engine ignition, which in turn speeds up time to plane by reducing the volume of water the exhaust gas has to force out of the exhaust system.

Referring to FIG. 2, the first leg 32 of the exhaust passage 30 advantageously provides a guiding duct above the torpedo housing 18 and is sized and shaped to cause expulsion of water from the exhaust gas as it is conveyed downwardly towards the propeller shaft bearing hub 26. Optionally, the supplementary vanes can be included to increase efficiency. The supplementary vanes can be non-coincident with the supporting spokes and configured to distribute exhaust gas evenly through the windows. The supplementary vanes can stop short of the windows or extend through the windows, as described herein above.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A marine drive for propelling a marine vessel, the marine drive comprising:

a lower gearcase;

a propeller shaft laterally extending through the lower gearcase and configured to support a propeller;

a propeller shaft bearing hub supporting the propeller shaft;

an exhaust passage that conveys exhaust gas through the lower gearcase to an underwater discharge outlet, the exhaust passage comprising a first leg that conveys the exhaust gas downwardly in the lower gearcase and a second leg that redirects the exhaust gas laterally from the first leg to the underwater discharge outlet;

wherein the propeller shaft bearing hub comprises a plurality of curved vanes that laterally redirects the exhaust gas from the first leg towards the underwater discharge outlet;

wherein the propeller shaft bearing hub has an upstream end and a downstream end and wherein the exhaust gas is conveyed onto the propeller shaft bearing hub between the upstream end and the downstream end and then laterally redirected towards the downstream end by the plurality of curved vanes;

wherein the propeller shaft bearing hub comprises a cylindrical body through which the propeller shaft extends, the cylindrical body having an outer surface on which the plurality of curved vanes are disposed; and a flow splitter located on top of the propeller shaft bearing hub and configured to split the exhaust gas as the exhaust gas is conveyed downwardly onto the propeller shaft bearing hub;

wherein the flow splitter comprises a dorsal fin that radially extends from the cylindrical body;

wherein the dorsal fin laterally extends from the upstream end to the downstream end; and wherein the plurality of curved vanes comprises opposing vane sections that extend away from each side of the dorsal fin along the cylindrical body.

2. A marine drive for propelling a marine vessel, the marine drive comprising:

a lower gearcase;

a propeller shaft laterally extending through the lower gearcase and configured to support a propeller;

a propeller shaft bearing hub supporting the propeller shaft;

an exhaust passage that conveys exhaust gas through the lower gearcase to an underwater discharge outlet, the exhaust passage comprising a first leg that conveys the exhaust gas downwardly in the lower gearcase and a second leg that redirects the exhaust gas laterally from the first leg to the underwater discharge outlet;

wherein the propeller shaft bearing hub comprises a plurality of curved vanes that laterally redirects the exhaust gas from the first leg towards the underwater discharge outlet;

wherein the propeller shaft bearing hub has an upstream end and a downstream end and wherein the exhaust gas is conveyed onto the propeller shaft bearing hub between the upstream end and the downstream end and then laterally redirected towards the downstream end by the plurality of curved vanes;

wherein the propeller shaft bearing hub comprises a cylindrical body through which the propeller shaft extends, the cylindrical body having an outer surface on which the plurality of curved vanes are disposed; and a ring at the downstream end, the outer ring being concentrically spaced apart from the cylindrical body by a plurality of spokes.

3. The marine drive according to claim 2, further comprising a flow splitter located on top of the propeller shaft bearing hub and configured to split the exhaust gas as the exhaust gas is conveyed downwardly onto the propeller shaft bearing hub.

4. The marine drive according to claim 3, wherein the flow splitter comprises a dorsal fin that radially extends from the cylindrical body.

5. The marine drive according to claim 4, wherein the dorsal fin laterally extends from the upstream end to the downstream end.

6. The marine drive according to claim 2, wherein the plurality of curved vanes is coincident with the plurality of spokes so that the exhaust gas passes between the ring and cylindrical body without being impeded by the plurality of spokes.

7. The marine drive according to claim 6, further comprising a plurality of supplementary vanes that are interdigitated amongst the plurality of curved vanes, wherein the plurality of supplementary vanes is not coincident with the plurality of spokes.

8. The marine drive according to claim 7, wherein the plurality of supplementary curved vanes comprises a first vane section and a second vane section that is longer than the first vane.

9. The marine drive according to claim 2, further comprising a guiding duct located above the lower gearcase, the guiding duct configured to cause expulsion of water from the exhaust gas as the exhaust gas is conveyed downwardly towards the propeller shaft bearing hub.

10. A propeller shaft bearing hub for supporting a propeller shaft in a marine drive, the propeller shaft bearing hub comprising:

a cylindrical body through which the propeller shaft extends, the cylindrical body having an outer surface extending between an upstream end and a downstream end;

a plurality of curved vanes on the outer surface, the plurality of curved vanes configured to redirect exhaust gas along the outer surface;

a flow splitter located on top of the propeller shaft bearing hub and configured to split the exhaust gas as the exhaust gas is conveyed downwardly onto the propeller shaft bearing hub, wherein the plurality of curved vanes comprises vane sections that extend away from each side of the flow splitter;

wherein the flow splitter comprises a dorsal fin that radially extends from the body cylindrical body, wherein the dorsal fin extends from the upstream end to the downstream end; and a ring at the downstream end, wherein the ring is concentrically spaced apart from the cylindrical body by a plurality of spokes, and wherein the plurality of curved vanes is coincident with the plurality of spokes so that the exhaust gas passes between the support ring and cylindrical body without being impeded by the plurality of spokes.

11. The propeller shaft bearing hub according to claim 10, further comprising a plurality of supplementary vanes that are interdigitated with the plurality of curved vanes, wherein the plurality of supplementary vanes is not coincident with the plurality of spokes, and wherein the plurality of supplementary vanes comprises a first vane section and a second vane section that is longer than the first vane section.

12. A propeller shaft bearing hub for supporting a propeller shaft in a marine drive, the propeller shaft bearing hub comprising a cylindrical body through which the propeller shaft extends, the cylindrical body having an outer surface extending between an upstream end and a downstream end; a plurality of curved vanes on the outer surface, the plurality of curved vanes configured to redirect exhaust gas along the outer surface; and a ring concentrically spaced apart from the cylindrical body at the downstream end by a plurality of spokes, wherein the plurality of curved vanes is coincident with the plurality of spokes so that the exhaust gas passes between the support ring and cylindrical body without being impeded by the plurality of spokes.

13. The propeller shaft bearing hub according to claim 12, further comprising a flow splitter located on top of the propeller shaft bearing hub and configured to split the exhaust gas as the exhaust gas is conveyed downwardly onto the propeller shaft bearing hub, wherein the plurality of curved vanes comprises vane sections that extend away from each side of the flow splitter.

14. The propeller shaft bearing hub according to claim 13, wherein the flow splitter comprises a dorsal fin that radially extends from the body cylindrical body and wherein the dorsal fin extends from the upstream end to the downstream end.

15. The propeller shaft bearing hub according to claim 14, further comprising a plurality of supplementary vanes that are interdigitated with the plurality of curved vanes, wherein the plurality of supplementary vanes is not coincident with the plurality of spokes, and wherein the plurality of supplementary vanes comprises a first vane section and a second vane section that is axially longer than the first vane section.

* * * * *